US005505910A

United States Patent [19]

Nishida et al.

[11] Patent Number: 5,505,910

[45] Date of Patent: Apr. 9, 1996

[54] CATALYTIC COMBUSTION APPARATUS

[75] Inventors: Toshio Nishida, Nara; Hiroki Sadamori, Kashihara; Shinichi Adachi, Sanda; Akira Hidaka, Itami; Mamoru Aoki, Kobe; Toshio Matsuhisa, Shimonoseki, all of Japan

[73] Assignees: Osaka Gas Co., Ltd.; Kobe Steel, Ltd.; Catalysts and Chemicals Inc., Far East, all of, Japan

[21] Appl. No.: 346,472

[22] Filed: Nov. 29, 1994

Related U.S. Application Data

[62] Division of Ser. No. 994,680, Dec. 22, 1992, Pat. No. 5,387,399.

[30] Foreign Application Priority Data

Dec. 26, 1991 [JP] Japan ..... 3-343731
Nov. 27, 1992 [JP] Japan ..... 4-318129

[51] Int. Cl.[6] ..... B01D 53/94

[52] U.S. Cl. ..... 422/171; 60/299; 422/177; 422/191; 422/192; 422/211; 422/222

[58] Field of Search ..... 422/170, 171, 422/177, 179, 180, 191, 192, 211, 222; 60/299; 29/890, 890.08

[56] References Cited

U.S. PATENT DOCUMENTS

| | | | |
|---|---|---|---|
| 3,235,344 | 2/1966 | Dreyer et al. | 422/191 |
| 3,386,580 | 6/1968 | Grabarczyk | 55/485 |
| 3,455,089 | 7/1969 | Mattia | 423/245.3 X |
| 3,780,924 | 10/1966 | Sexton et al. | 55/518 X |
| 3,791,143 | 2/1974 | Keith et al. | 422/171 |
| 3,859,067 | 1/1975 | Dasek et al. | 55/485 |
| 4,169,127 | 9/1979 | Ashworth et al. | 422/180 |
| 4,353,720 | 10/1982 | Margraf | 422/191 X |
| 4,416,674 | 11/1983 | McMahon et al. | 55/485 |
| 4,425,304 | 1/1984 | Kawata et al. | 55/DIG. 32 X |
| 4,673,420 | 1/1987 | Haker et al. | 55/516 X |
| 4,758,410 | 7/1988 | Grimm et al. | 422/171 X |
| 4,900,517 | 2/1990 | Domesle et al. | 55/DIG. 30 X |
| 4,913,712 | 4/1990 | Gabarthuler et al. | 55/DIG. 30 X |
| 5,135,551 | 8/1992 | Fielding | 55/516 X |

FOREIGN PATENT DOCUMENTS

| | | |
|---|---|---|
| 57-6215 | 1/1982 | Japan . |
| 62935 | 1/1987 | Japan . |
| 64-90040 | 4/1989 | Japan . |

OTHER PUBLICATIONS

International Integration of Coal Technology, EPRI Journal, Jan./Feb. 1986, vol. 11, Number 1, pp. 38–39.

*Primary Examiner*—Timothy M. McMahon
*Attorney, Agent, or Firm*—Webb Ziesenheim Bruening Logsdon Orkin & Hanson

[57] ABSTRACT

A catalytic combustion apparatus has a cylindrical housing defining a fluid passage, and a plurality of combustion catalyst bodies arranged face to face along the fluid passage in the cylindrical housing. The catalyst bodies are loosely fired in the cylindrical housing. Each catalyst body defines numerous bores extending along the fluid passage. The cylindrical housing includes holders extending inwardly of the housing for contacting end surfaces of the catalyst bodies to prevent movement thereof along the fluid passage.

5 Claims, 10 Drawing Sheets

CATALYTIC COMBUSTION APPARATUS

This is a divisional of copending application Ser. No. 07/994,680 filed on Dec. 22, 1992, U.S Pat. No. 5,387,399.

BACKGROUND OF THE INVENTION

1. Field of the Invention

This invention relates to catalytic combustion apparatus, and more particularly to a low NOx catalytic combustion apparatus having a cylindrical housing defining a fluid passage, and a plurality of combustion catalyst bodies arranged face to face in a direction of fluid flow through the cylindrical housing and defining numerous bores extending in the direction of fluid flow.

2. Description of the Related Art

In view of the increasing environmental pollution by NOx discharged from combustion equipment, there is a desire for means to achieve a drastic reduction in NOx produced in combustion processes. One of such NOx reducing means is a premixed catalytic combustion method which uses combustion catalysts in honeycomb form having numerous bores extending in a direction of fluid flow. This method is known to assure stable combustion at 1100° to 1300° C. while drastically reducing generation of NOx. Studies are being made on the possibility of utilizing this feature as means to realize an extremely low NOx generation in gas turbines. Studies are also made as to its use as means to afterburn an exhaust fuel and air mixture from fuel cells. Further studies are made as to application thereof to boilers and burners used in industry.

A combustion catalyst in plate form has been developed heretofore, which includes a rare metal such as palladium or platinum supported by a cordierite honeycomb base through a coating material such as alumina. The cordierite honeycomb base is a material that achieves a considerably low coefficient of thermal expansion in the order of $1.4\times10^{-6}$/°C. However, this honeycomb base is said to have a maximum working temperature at 1400° C., and thus has its limitations in use at high temperatures. The catalyst having this construction encounters a deterioration in activity at temperatures above 1000° C. This is due to a reduction in specific surface area caused by vaporization of the rare metal and sintering of the coating material.

Under the circumstances. Inventors have proposed a catalytic combustion apparatus employing a palladium/cordierite combustion catalyst in a low temperature, upstream stage, and a manganese substituted laminar aluminate catalyst in a high temperature, intermediate to downstream stage. The manganese substituted laminar aluminate catalyst has a melting point at 1600° C. or above. Thus, this catalyst has a characteristic to remain highly active even at 1300° C., with a large specific surface area maintained over a long period of time.

In the conventional construction, each catalyst body is formed into a plate covering an entire sectional area perpendicular to a direction of fitted flow, with peripheral edges thereof bonded to a cylindrical housing. A plurality of such catalyst bodies are arranged at intervals in the direction of fluid flow. These intervals serve to limit thickness of each catalyst body, and to diminish temperature variations in the direction of its thickness, thereby to suppress thermal stress. Further, the intervals are effective to hamper an increase in resistance to gas flows due to displacement or non-alignment among the bores formed in the catalyst bodies.

However, where the combustion catalyst bodies are fixed to the cylindrical housing with the peripheral edges bonded thereto, the catalyst bodies cannot expand or contract freely with temperature variations. Thus, the catalyst bodies could be damaged by the thermal stress resulting therefrom.

An attempt as shown in FIG. 14 has been made to solve the above problem. The illustrated apparatus includes combustion catalyst bodies 5 having peripheral edges just opposed to a cylindrical housing 3 without being bonded thereto. An annular metallic spacer 9, for example, is placed between an adjacent pair of catalyst bodies 5 to secure a spacing therebetween for releasing thermal stress. With this construction, however, a fluid pressure applied to an upstream catalyst body 5 is passed on to a next catalyst body 5 through the spacer 9 therebetween. This occurs successively from upstream to downstream until the final catalyst body 5 is subjected to a great concentration of forces which could damage this catalyst body 5. Furthermore, temperature differences tend to occur between portions of the catalyst bodies 5 contacting the metallic spacers 9 and portions out of contact with the spacers 9. Such temperature differences could promote damage to the catalyst bodies 5.

Further, an increased combustion capacity is needed in order that the above high temperature combustion catalyst may be better suited for practical purposes. To increase the quantity of gas processing by the combustion catalyst bodies 5 without impairing their ability to lower NOx level, the catalyst bodies must have increased areas. In this case, however, there is an inevitable limitation of size in forming an integral honeycomb structure while maintaining dimensional precision and strength. For example, a high degree of activity is required in addition to strength. Where a combustion catalyst body is required to have at least 200 cells per square inch, a size about 200 mm in diameter or 200 mm square is considered its limitation.

Studies made heretofore to achieve an increased capacity include, for example, a method in which small catalytic combustion apparatus are manufactured and connected in parallel to form a multiple type assembly, and a method in which a plurality of honeycomb catalyst segments having a size not exceeding a size corresponding to the 200 mm diameter are joined or bonded together to increase sectional areas.

However, the former multiple type assembly of catalytic combustion apparatus connected in parallel has a large and complicated overall construction which is expensive to manufacture and difficult to maintain. Thus, such an assembly is hardly practicable.

The latter bonding method uses a material different from the combustion catalyst for bonding purposes. Since the combustion catalyst is used at temperatures exceeding 1000° C., a solid phase reaction between the two different materials tends to cause a deterioration in the joints. The catalyst segments may be bonded by using a similar material, with the advantages that the solid phase reaction between the materials may be suppressed and that the materials have the same coefficient of thermal expansion. However, it is difficult to form joints having a thickness corresponding to that of cell walls. The longer the bonding surfaces are, the less uniform become mechanical strength and temperature distribution due to the unevenness in thickness. This gives rise to the problem that cracks tend to be formed in regions adjacent the joints. This problem is serious particularly with the manganese substituted laminar aluminate catalyst which has a greater coefficient of thermal expansion, 6 to $8\times10^{-6}$/°C., than the cordierite honeycomb combustion catalyst, and which is subjected to a thermal stress several times that of the latter catalyst.

The honeycomb catalyst could be damaged also by a stress concentration due to a difference in coefficient of thermal expansion, heat conduction or mechanical strength between the metallic spacer and honeycomb catalyst.

SUMMARY OF THE INVENTION

An object of the present invention is to provide an improved catalytic combustion apparatus having a catalytic combustion chamber of large diameter to process a large quantity of gas without impairing the catalytic performance to achieve a low NOx level, which apparatus reduces a stress accumulation in the combustion catalyst due to thermal distortion and the like, avoids a concentration of fluid pressure on portions of the combustion catalyst close to a downstream end, and prevent deformation and cracking of the catalyst even where the catalyst is a honeycomb catalyst having a low mechanical strength or where the catalyst is used under a high temperature working condition.

The above object is fulfilled, according to the present invention, by a catalytic combustion apparatus wherein the combustion catalyst bodies are loosely fitted in the cylindrical housing, and the cylindrical housing includes holders for contacting end surfaces of the combustion catalyst bodies extending transversely of the fluid passage to prevent movement of the combustion catalyst bodies along the fluid passage.

The present invention has the following functions and effects.

The combustion catalyst bodies are loosely fitted in the cylindrical housing, and the holders attached to the cylindrical housing contact end surfaces of the combustion catalyst bodies with respect to the fluid passage to prevent movement of the combustion catalyst bodies in the direction of their thickness. The combustion catalyst bodies have peripheral edges free from clamping action, and are allowed to make thermal expansion and contraction. Consequently, the combustion catalyst bodies are little subjected to thermal stress.

A fluid pressure applied to the combustion catalyst bodies are borne by the holders supporting the catalyst bodies. This is distinct from the prior art construction in which the metallic spacers as well as the catalyst bodies are loosely fitted in the cylindrical housing so that fluid pressures applied to upstream catalyst bodies are successively added to downstream catalyst bodies through the metallic spacers. Thus, the present invention eliminates the risk of the final combustion catalyst body being damaged by a great concentration of forces as experienced in the prior art.

The holders may only support a plurality of peripheral positions of the combustion catalyst bodies, for example. This diminishes the possibility of damage for the above reason, and thus facilitates a certain diametric enlargement. Where the holders include catalyst supports for supporting radially central portions of the combustion catalyst bodies, the catalyst bodies having limitations in their size may be combined to readily realize significantly enlarged sectional areas while avoiding damage to the catalyst bodies. Large combustion catalyst bodies each of which cannot be formed integral (but a plurality of moldable combustion catalyst bodies are combined into a plate form) may be fitted in a correspondingly large cylindrical housing. For example, each catalyst body may include a plurality of sector-shaped segments formed separately and arranged on a plane perpendicular to the fluid passage to constitute a circular body. These segments may be arranged in abutment with one another and loosely fitted in the large diameter cylindrical housing without using an adhesive.

In this case, the holders may comprise bridging elements extending between a plurality of positions of the cylindrical housing. Such holders may readily be formed with catalyst supports, which further facilitates a diametric enlargement of the combustion catalyst bodies.

The holders may be loosely fitted at ends thereof in grooves formed in a plurality of positions of the cylindrical housing to be supported by the cylindrical housing. This construction accommodates thermal expansion and contraction of the holders. Consequently, the holders may be formed of ceramic, for example, without possibility of damage due to thermal stress occuring in the holders per se.

In the prior art, the spaces between adjacent pairs of the combustion catalyst bodies are secured by using an adhesive or metallic spacers. In the present invention, these spaces are secured by means of the holders. These spaces prevent an increased resistance to fluid flows due to displacement between the bores formed in the combustion catalyst bodies. In addition, the holders can support the combustion catalyst bodies in a manner to allow a thermal expansion of the catalyst bodies, thereby avoiding thermal stress occurring therein. This facilitates prevention of damage done to the combustion catalyst bodies by thermal stress. This construction can also avoid the possibility of the final combustion catalyst body being damaged by a great concentration of forces which results from fluid pressures applied to upstream catalyst bodies being successively added to downstream catalyst bodies through metallic spacers.

The holders can support, in the manner to allow thermal expansion and avoid thermal stress, large catalyst bodies each formed of a plurality of segments joined through relatively small bonding or mating surfaces or simply placed in abutment without using an adhesive. That is, even for installation in a large capacity combustion apparatus, each combustion catalyst body may be formed of relatively small segments. Compared with a large integral combustion catalyst body, each segment has a small amount of expansion for the same coefficient of expansion. This also reduces the possibility of damage due to thermal stress.

Consequently, the present invention provides a catalytic combustion apparatus capable of processing a large quantity of gas by increasing the diameter of the cylindrical housing, without impairing the catalytic performance to achieve a low NOx level. This apparatus also avoids damage done to the combustion catalyst bodies by reducing a stress concentration due to thermal distortion and the like even if the catalyst bodies have a honeycomb structure of low mechanical strength, for example.

The foregoing and other objects, features and advantages of the invention will be apparent from the following more particular description of preferred embodiments of the invention, as illustrated in the accompanying drawings.

DETAILED DESCRIPTION OF THE PREFERRED EMBODIMENTS

Catalytic combustion apparatus according to the present invention will be described in detail with reference to the drawings.

Figure 1:
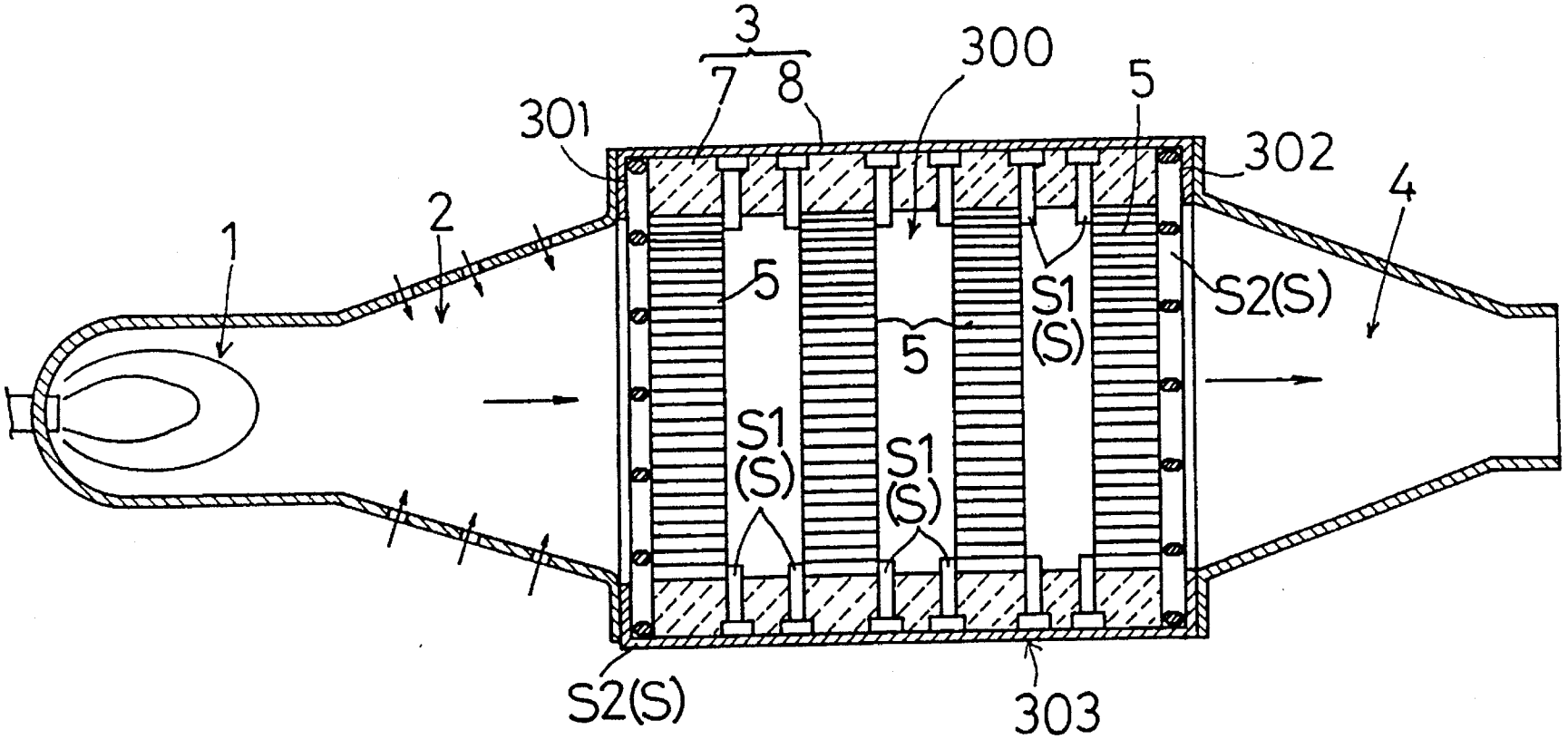
FIG. 1 is a view in axial section of a catalytic combustion apparatus according to the present invention, FIGS. 2(*a*) and (*b*) are a cross section and a fragmentary vertical section, respectively, of a catalytic combustion apparatus in another embodiment of the invention, FIGS. 3(*a*) and (*b*) are a cross section and a fragmentary vertical section, respectively, of a catalytic combustion apparatus in a further embodiment of the invention.

FIG. 1 shows an axial section of a catalytic combustion apparatus. This catalytic combustion apparatus includes a preheating combustion chamber 1, a lean combustion gas mixing chamber 2, a catalytic combustion chamber 300 defined by a cylindrical housing 3, and a combustion gas exhaust section 4, arranged in the stated order along a combustion gas passage. The cylindrical housing 3 contains a plurality of disk-shaped combustion catalyst bodies 5 arranged face to face along the passage therethrough. Each catalyst body 5 is formed of a honeycomb catalyst and defines numerous bores extending in the direction of its thickness. The cylindrical housing 3 includes a cylindrical inner frame 7 formed by compacting a high-temperature resisting ceramic fiber, and a cylindrical outer frame 8 formed of steel to act as reinforcement. Each combustion catalyst body 5 is loosely fitted in the cylindrical housing 3. The cylindrical housing 3 has a plurality of bolt-shaped engaging elements S1 extending through the cylindrical inner frame 7 into its interior to act as holders S for the combustion catalyst bodies 5. The holders S contact end surfaces of the combustion catalyst bodies 5 to hold the catalyst bodies 5 immovable in the direction of their thickness.

The cylindrical outer steel frame 8 defines an inlet end plane 301 and an outlet end plane 302 of the catalytic combustion chamber 300, as well as an outer peripheral wall 303 of the combustion chamber 300. The cylindrical inner frame 7 acts as an inner frame member for supporting the combustion catalyst bodies 5 arranged in different positions in the direction of gas flow.

Further, the cylindrical housing 3 has grids S2 attached to opposite ends thereof for supporting substantially entire areas of the combustion catalyst bodies 5, in order to preclude possibility of the catalyst bodies 5 being blown off.

The engaging elements S1 and grids S2 are formed of a silicon carbide ceramic material.

The above construction is capable of supporting the plurality of combustion catalyst bodies 5 in a manner to allow a thermal expansion thereof, whereby the catalyst bodies 5 are protected from damage due to thermal stress. Further, the combustion catalyst bodies 5 are subjected to fluid pressures in a different way to the prior art. That is, a fluid pressure applied to an upstream catalyst body 5 is not passed on to a next catalyst body 5 through a metallic spacer therebetween. There is no possibility of progressively increasing loads falling on downstream catalyst bodies 5. The apparatus according to the present invention is free from the local heat distortion often experienced with use of metallic spaces as in the prior art. This apparatus also is readily adaptable for an increase in diameter.

Other embodiments will be described hereinafter.

Figure 2B:
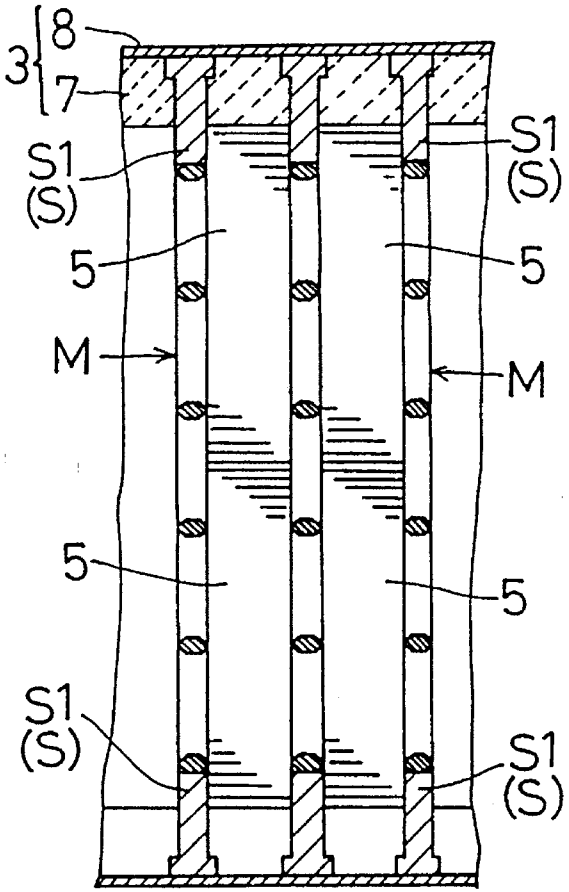
Figure 2A:
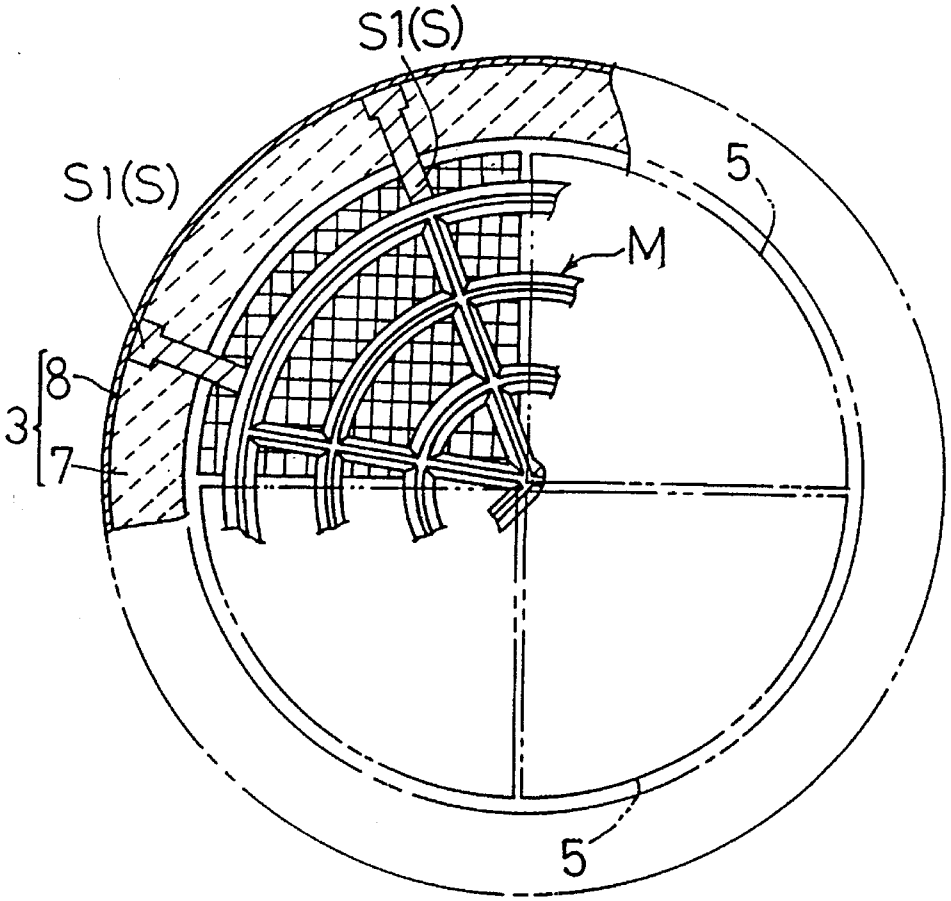

FIGS. 2(*a*) and (*b*) show a cross section and a fragmentary vertical section of a catalytic combustion apparatus including large diameter combustion catalyst bodies 5 loosely fitted in a cylindrical housing 3 formed of a cylindrical inner frame 7 and a cylindrical outer steel frame 8. Each combustion catalyst body 5 includes four sector-shaped segments divided in directions perpendicular to the gas passage and arranged adjacent to one another to form a circle without using an adhesive. Each combustion catalyst body 5 is supported by the cylindrical housing 3 through a plurality of bolt-shaped holders S (S1) extending radially inwardly from the cylindrical housing 3 and contacting peripheral end surfaces of the combustion catalyst body 5 to hold the catalyst body 5 immovable in the direction of its thickness. Reference "M" in the drawings denotes radial intermediate spacers formed of ceramic and each dividing an annular interior radially and circumferentially. The intermediate spacers M are clamped radially by the holders S (S1) to contact intermediate positions of the combustion catalyst bodies 5, thereby to secure a space between an adjacent pair of catalyst bodies 5. This construction further facilitates diametric enlargement of the combustion catalyst bodies 5 and cylindrical housing 3.

Figure 3B:
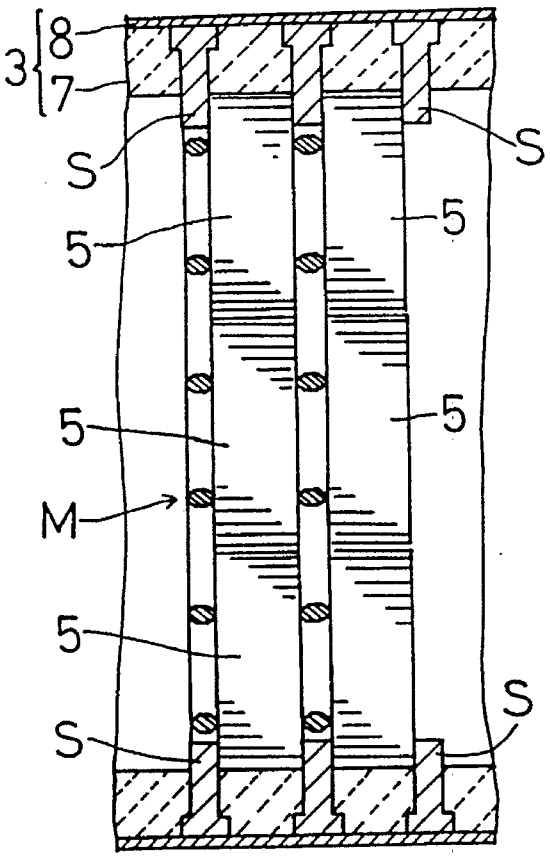
Figure 3A:
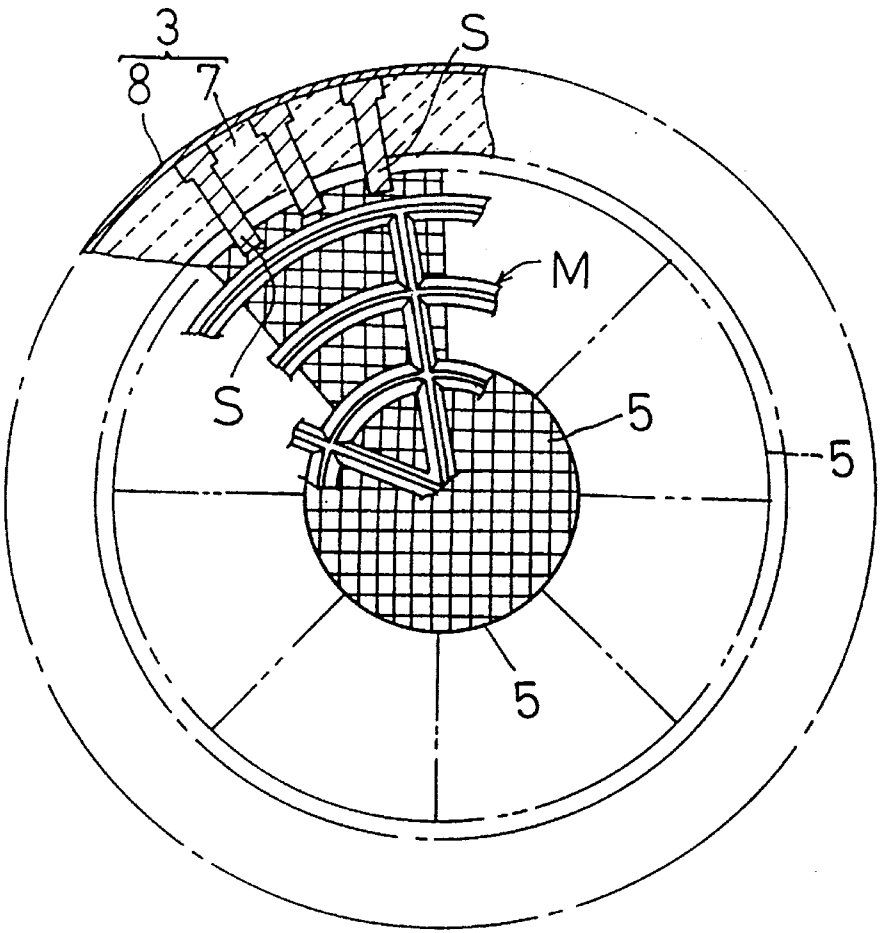

FIGS. 3(*a*) and (*b*) show a cross section and a fragmentary vertical section of a catalytic combustion apparatus in a further embodiment. This apparatus also includes large diameter combustion catalyst bodies 5 loosely fitted in a cylindrical housing 3 formed of a cylindrical inner frame 7 and a cylindrical outer steel frame 8. As shown in FIG. 3(*a*), each combustion catalyst body 5 is formed of a disk-shaped segment, and eight sector-shaped segments arranged close to one another and around the disk-shaped segment to form a large disk as a whole without using an adhesive. As in the construction shown in FIG. 2, the cylindrical housing 3 has beat clapper-like engaging elements projecting inwardly to act as holders S. A radially intermediate spacer M as in the p receding embodiment is disposed between an adjacent pair of combustion catalyst bodies 5. The intermediate spacers M have radial play instead of being clamped by the holders S. The loads applied to peripheral regions of the combustion catalyst bodies 5 are borne by the holders S contacting the peripheral regions. The loads applied to central regions of the catalyst bodies 5 are transmitted through the intermediate spacers M to the peripheral regions of downstream combustion catalyst bodies 5.

Figure 4:
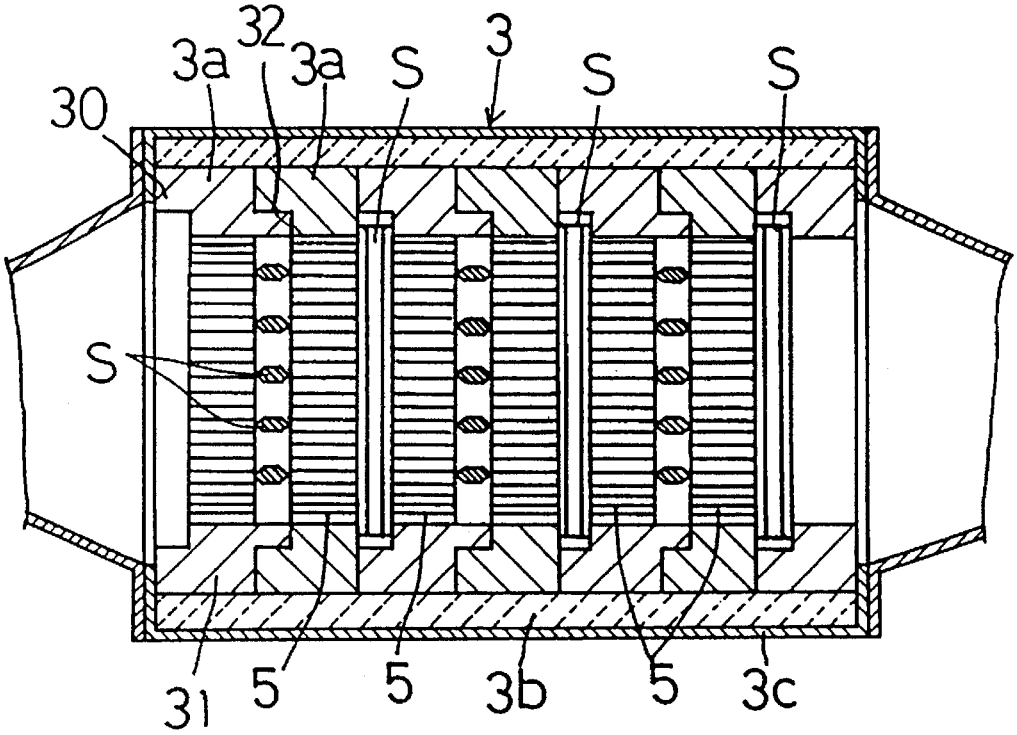
FIG. 4 is a vertical section of a catalytic combustion apparatus in a still further embodiment of the invention.
Figure 5:
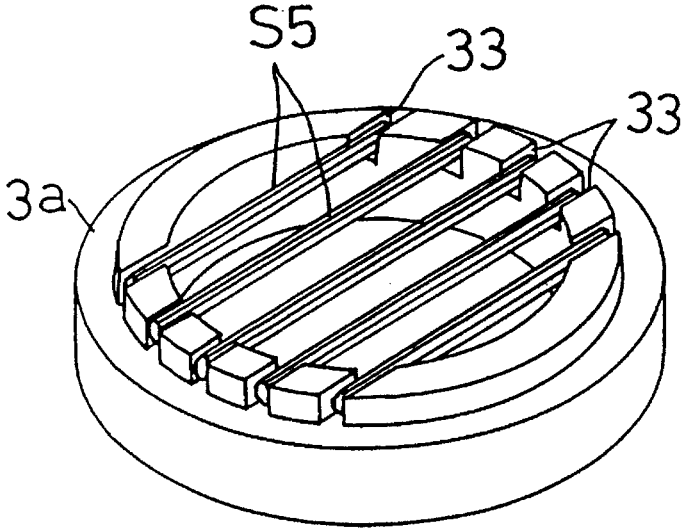
FIG. 5 is a perspective view of a portion of the catalytic combustion apparatus shown in FIG. 4.

FIG. 4 shows a vertical section of a further embodiment. Large diameter combustion catalyst bodies 5 are loosely fitted in a cylindrical housing 3. The cylindrical housing 3 includes a plurality of supporting cylinders 3*a* arranged axially thereof to constitute an inner frame, a heat insulator 3*b* wound around the inner frame, and a reinforcing steel sheet 3*c* covering the heat insulator 3*b* to act as an outer frame. Each supporting cylinder 3*a* includes a large diameter portion 30 and a small diameter portion 32 formed on axially opposite ends thereof, and a thick wall portion 31 formed between the large diameter portion 30 and small diameter portion 32. The thick wall portion 31 has an inside diameter equal to an inside diameter of the small diameter portion 32, and an outside diameter equal to an outside diameter of the large diameter portion 30. The supporting cylinders 3*a* are joined together, with the large diameter portion 30 of one supporting cylinder 3*a* accommodating the small diameter portion 32 of another. As shown in perspective in FIG. 5, the small diameter portion 32 defines grooves 33 for loosely receiving bridging elements S5 (acting as holders S) extending parallel to one another. Each bridging element S5 extends between opposite grooves 33 to be thermally expandable and contractible. Each combustion catalyst body 5 is loosely fitted in the thick wall portion 31. As shown in exploded perspective in FIG. 6, each supporting cylinder 3*a* has bridging elements S5 extending at right angles to the bridging elements S5 of the next supporting cylinder 3*a*, for contacting each combustion catalyst body 5 and preventing movement thereof in the direction of its thickness. These supporting cylinders 3*a* are joined together to constitute a principal portion of the catalytic combustion apparatus as shown in FIG. 4. Central parts of the bridging elements S5 act as catalyst supports for supporting radially intermediate portions of the combustion catalyst bodies 5.

Figure 7:
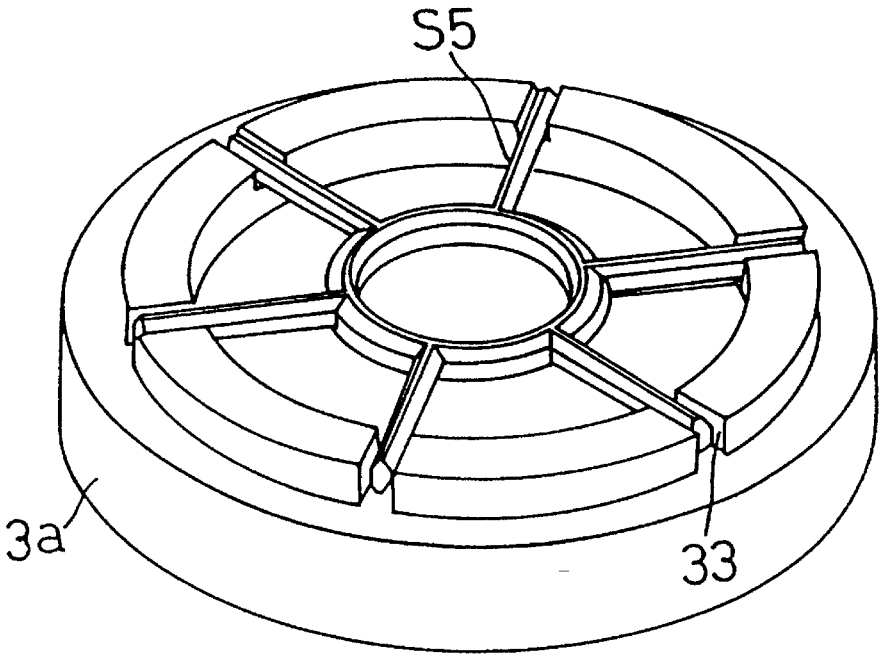
FIG. 7 is a perspective view of a portion of a catalytic combustion apparatus in a still further embodiment of the invention.
Figure 8:
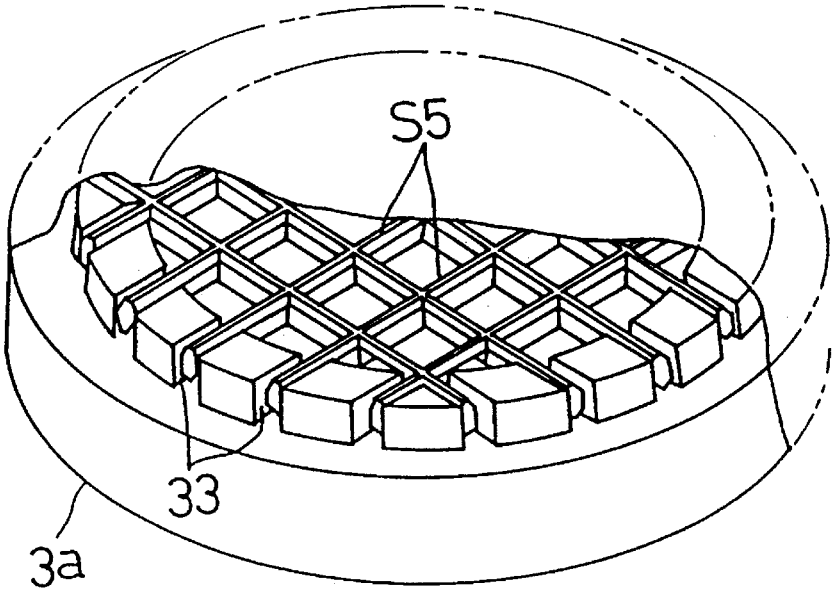
FIG. 8 is a perspective view of a portion of a catalytic combustion apparatus in a still further embodiment of the invention, FIGS. 9(*a*) through (*d*) are views showing sectional shapes of intermediate spacers and holders of catalytic combustion apparatus in still further embodiments, FIGS. 10(*a*) through (*f*) are views showing combinations of combustion catalyst segments of catalytic combustion apparatus in still further embodiments, FIGS. 11(*a*) through (*d*) are views showing relations between configuration and cell grid of combustion catalyst segments of catalytic combustion apparatus in still further embodiments.
Figure 9A:
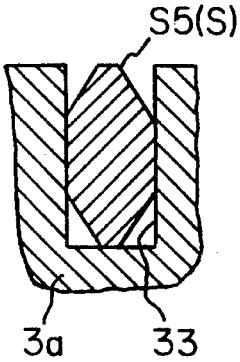
Figure 9B:
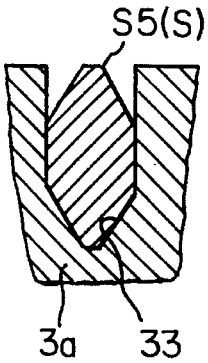
Figure 9C:
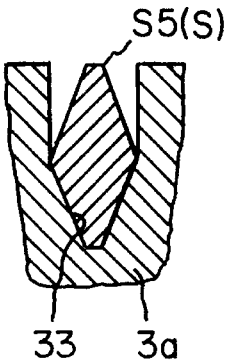
Figure 9D:
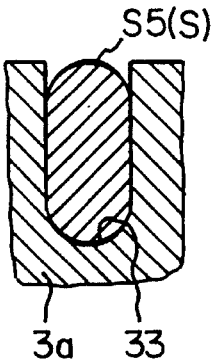
Figure 10A:
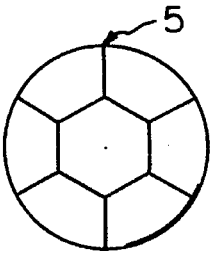
Figure 10B:
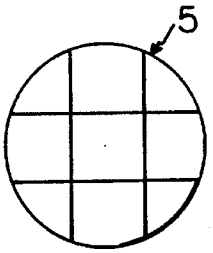
Figure 10C:
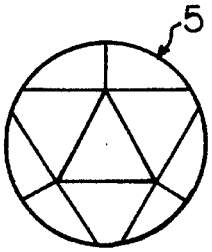
Figure 10D:
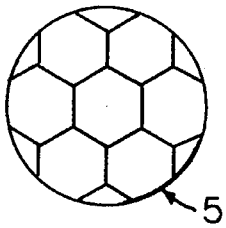
Figure 10E:
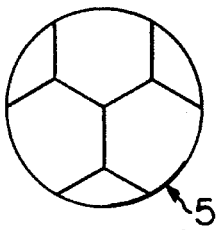
Figure 10F:
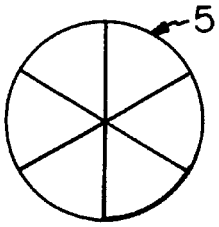
Figure 11A:
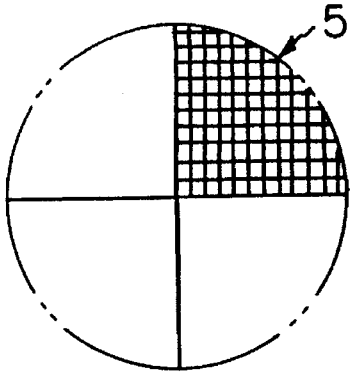
Figure 11B:
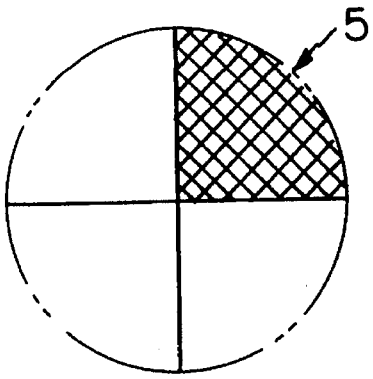
Figure 11C:
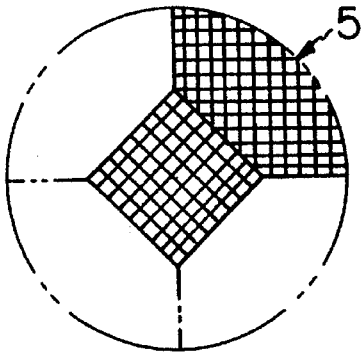
Figure 11D:
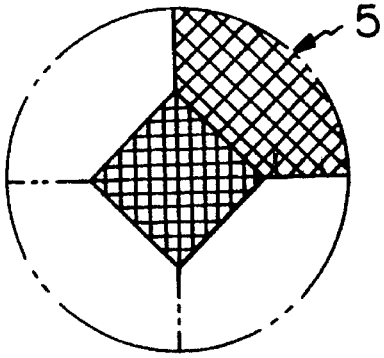

The bridging elements S5 having the catalyst supports in the construction shown in FIG. 4 may be modified to have a radial configuration as shown in FIG. 7 or to be in grid form as shown in FIG. 8.

Sectional shapes of the intermediate spacers M shown in FIGS. 2 and 3 and the holders S or bridging elements S5 shown in FIGS. 4 through 8 will be described next. These components may have minimal areas for contacting the combustion catalyst bodies 5 in order not to close the bores defining cells of the catalyst bodies 5 which would lead to damage due to temperature differences within the catalyst bodies 5. Further, these components may be streamlined to have little or no influence on gas flows. Specifically, their sectional shape is rhomboid.

The bridging elements S5 and grooves 33 may have other sectional shapes as shown in FIG. 9.

Figure 6:
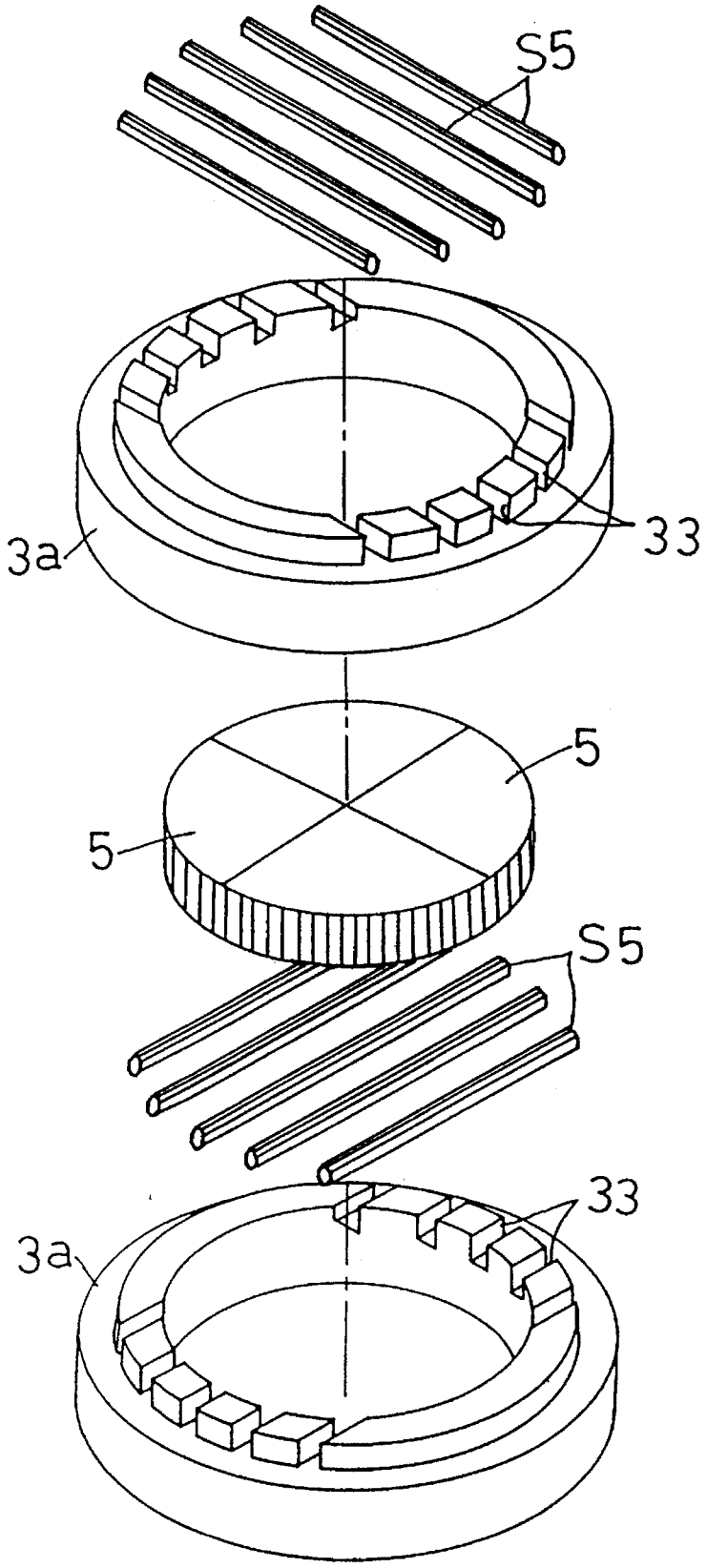
FIG. 6 is an exploded perspective view of a portion of the catalytic combustion apparatus shown in FIG. 4.

The fitting patterns of the combustion catalyst bodies 5 shown in FIGS. 3 and 6 may be modified as shown in FIGS. 10(*a*) through (*f*). For an enlarged combustion apparatus, the patterns shown in FIGS. 10(*b*) and (*d*) are preferred for facility of mass production.

The patterns of the combustion catalyst bodies 5 may be varied in relation to directions in which the cell grids are formed. As shown in FIG. 11, the catalyst patterns may have outlines extending in the directions in which the cell grids are formed, or intersecting such directions at 45 degrees. or may be combinations of these. However, it is preferable that the outlines of the catalyst patterns have a certain relationship with the direction of the cell grids. The pattern shown in FIG. 11(*c*) has proved to produce desired results concerning thermal stress.

Figure 12:
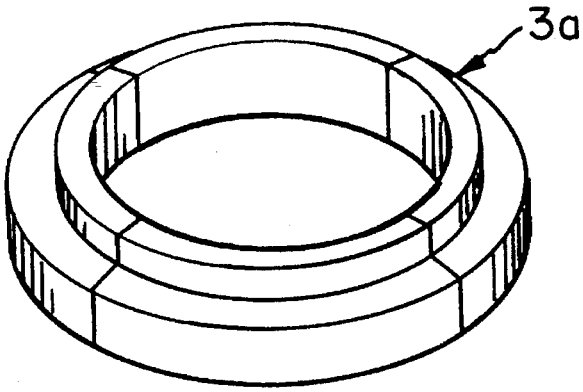
FIG. 12 is a view showing a split type support cylinder of a catalytic combustion apparatus in a still further embodiment.

Each of the supporting cylinders 3*a* shown in FIGS. 4 through 8 may be modified to comprise a combination of circumferentially divided parts as shown in FIG. 12.

Figure 13:
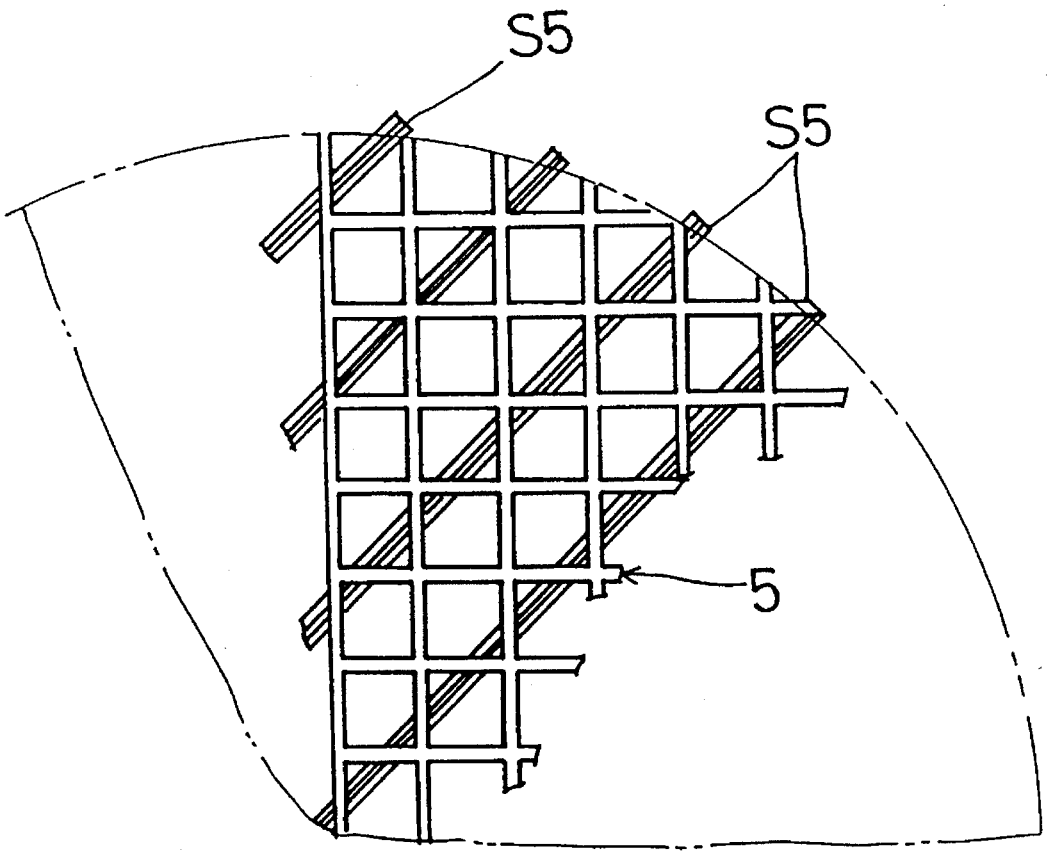
FIG. 13 is a view showing a relationship between bridging elements and cell grids of a catalytic combustion apparatus in a still further embodiment.

In the embodiments shown in FIGS. 4 through 8, there should desirably be a particular relationship between the direction in which the cells are formed in the combustion catalyst bodies 5 and the direction in which the bridging elements S5 extend. As shown in FIG. 13, cell walls and the bridging elements S5 form an angle of 45 degrees therebetween.

With this arrangement, each bridging element S5 has an increased area for supporting the combustion catalyst body 5, thereby to lighten the load borne by the cell walls.

The combustion catalyst bodies 5 of honeycomb structure have small cell dimensions (about 1.5 mm for one side). If the bridging elements S5 were placed along rows of cells, the gas would flow less smoothly through the cells opposed to the bridging elements S5. However, with the rows of cells inclined 45 degrees, increased cell openings present little resistance to the gas flows.

EXPERIMENT

An experiment was conducted using one combustion catalyst body 5 formed of palladium cordierite, 20 mm thick, and having 200 cells per inch square; four combustion catalyst bodies 5 formed of low temperature active, manganese substituted hexa-aluminate, 20 mm thick, and having 300 cells per inch square; and two combustion catalyst bodies 5 formed of high temperature resisting, manganese substituted hexa-aluminate, 20 mm thick, and having 300 cells per inch square. Each of these combustion catalyst bodies 5 had an enlarged construction with four segments arranged close to one another. The catalyst bodies 5 were arranged in the order stated above, as in FIGS. 4 through 6, and loosely fitted in a cylindrical housing to constitute a cassette. The catalyst bodies 5 had an effective diameter of 220 mm.

This cassette was incorporated into a catalytic combustion apparatus for a 150 kw gas turbine. The experiment was started with a precombustion mode, and then shifted to a catalytic combustion mode. The operation continued in the catalytic combustion mode under a rated load condition for four hours, and was then stopped. The combustion catalyst bodies were at 1000° C. at start and a maximum temperature of the catalyst bodies was 1200° C. in the catalytic combustion mode. The starting time was about 20 seconds. The efficiency of catalytic combustion under the rated load condition was not less than 99%. The experiment produced the results that no abnormality occurred with the outward appearance of the catalyst cassette, and that no cracking was observed in any catalyst bodies 5. It has been proved that the catalytic combustion apparatus capable of such catalyst retention sufficiently withstands rapid temperature increases and decreases as well as the thermal stress resulting from stationary combustion.

COMPARATIVE EXPERIMENT

Figure 14:
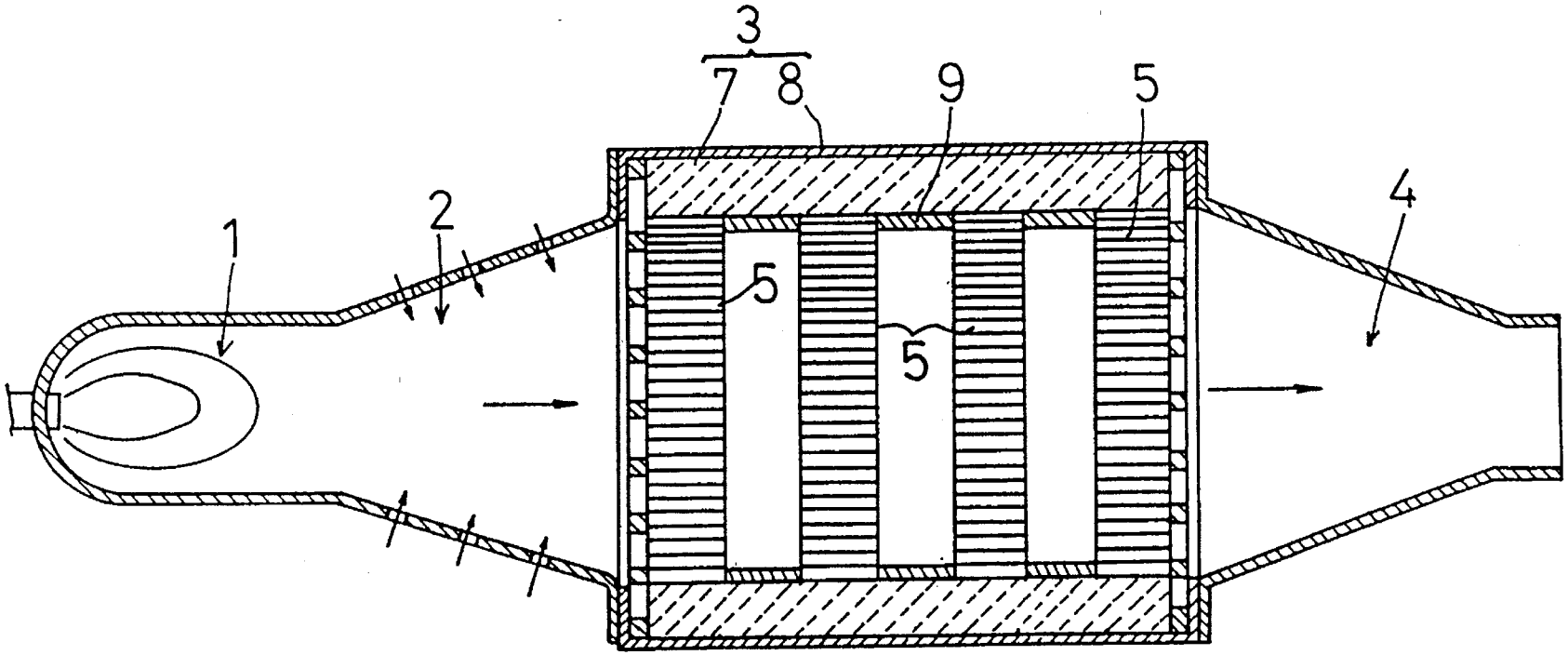
FIG.14(PRIOR ART)
FIG. 14 is a vertical section of a conventional catalytic combustion apparatus.

Each of the combustion catalyst bodies was formed of four segments of the same materials as above bonded together to form a disk having the 220 mm diameter and 20 mm thickness. As shown in FIG. 14, the combustion catalyst bodies 5 were placed in an inner cylinder 7 formed of a heat insulating material, with annular metallic spacers 9 interposed between the catalyst bodies 5. The inner cylinder 7 was covered with a metallic outer cylinder 8 to form a cylindrical housing 3 and constitute a cassette as in the above experiment. This cassette was assembled to a catalytic combustion apparatus to carry out a turbine running test.

This test produced a similar combustion performance to the above experiment. The first combustion catalyst body 5 formed of palladium cordierite remained intact, but all of the other combustion catalyst bodies 5 formed of manganese substituted hexa-aluminate showed local cracking in or adjacent the joints. Thus, it has been found that the catalytic combustion apparatus according to this catalyst retention method fails to assure long-term durability.

What is claimed is:

1. A catalytic combustion apparatus comprising:

a cylindrical housing defining a fluid passage;

a plurality of combustion honeycomb catalyst bodies transversely disposed in said cylindrical housing and defining numerous bores extending along said fluid passage, wherein said combustion catalyst bodies are loosely fitted in said cylindrical housing to allow for thermal expansion and contraction of said combustion catalyst bodies; and holders provided in said cylindrical housing for contacting end faces of said combustion catalyst bodies extending transversely of said fluid passage to prevent axial movement of said combustion catalyst bodies along said fluid passage, said holders including:

a grid provided at an outlet portion of said cylindrical housing for supporting substantially an entire area of at least one adjacent of said combustion catalyst bodies;

a plurality of engaging elements fixed within said cylindrical housing in between each successive pair of combustion catalyst bodies and extending from an outer member of said cylindrical housing through an inner face of said cylindrical housing, leading ends of said engaging elements projecting into said cylindrical housing, said engaging elements contacting end surfaces of said combustion catalyst bodies thereby to hold said combustion catalyst bodies against axial movement thereof along said fluid passage; and means for fixedly positioning said engaging elements, said means being provided to said cylindrical housing so as to cause the leading ends of said engaging elements to project into said cylindrical housing by a predetermined projecting length.

2. A catalytic combustion apparatus as defined in claim 1, wherein said cylindrical housing further includes a cylindrical inner frame, said outer member comprises a cylindrical outer frame, and said means for fixedly positioning said engaging elements comprises a recess defined in the outer face of said cylindrical inner frame, while each said engaging element is a bolt-shaped element having a head portion inserted into said recess.

3. A catalytic combustion apparatus as defined in claim 1 wherein said holders further include a second grid provided at an inlet portion of said cylindrical housing.

4. A catalytic combustion apparatus as defined in claim 3 wherein said holders further include a plurality of spacers disposed between each successive pair of combustion catalyst bodies.

5. A catalytic combustion apparatus as defined in claim 4 wherein said spacers are clamped radially by said engaging elements.

* * * * *

UNITED STATES PATENT AND TRADEMARK OFFICE

CERTIFICATE OF CORRECTION

PATENT NO. : 5,505,910

DATED : April 9, 1996

INVENTOR(S) : Toshio Nishida, Hiroki Sadamori, Shinichi Adachi, Akira Hidaka, Mamoru Aoki and Toshio Matsuhisa It is certified that error appears in the above-indentified patent and that said Letters Patent is hereby corrected as shown below:

Title page, item '[73] Assignees:', "all of, Japan" should read --all of Japan--.

Title page, after item '[73] Assignees:' information, insert --[*] Notice: The portion of the term of this patent subsequent to Dec. 22, 2012 has been disclaimed.--.

Abstract Line 5 "fired" should read --fitted--.

Column 1 Line 47 "circumstances. Inventors" should read --circumstances, inventors--.

Column 1 Line 59 "fitted" should read --fluid--.

Column 4 Line 67 "invention." should read --invention,--.

Column 6 Line 61 "p receding" should read --preceding--.

Claim 4 Line 25 Column 10 "3" should read --2--.

Signed and Sealed this

Sixth Day of August, 1996

Bruce Lehman

*Attest:*

BRUCE LEHMAN

*Attesting Officer*

*Commissioner of Patents and Trademarks*